United States Patent [19]

Maruyama

[11] 4,407,639

[45] Oct. 4, 1983

[54] COMPRESSOR

[75] Inventor: Teruo Maruyama, Neyagawa, Japan

[73] Assignee: Matsushita Electric Industrial Co., Ltd., Osaka, Japan

[21] Appl. No.: 341,607

[22] Filed: Jan. 22, 1982

[30] Foreign Application Priority Data

Jan. 29, 1981 [JP] Japan ..... 56-12425

[51] Int. Cl.[3] ..... F04B 49/00

[52] U.S. Cl. ..... 417/292

[58] Field of Search ..... 417/292

[56] References Cited

U.S. PATENT DOCUMENTS 4,025,239 5/1977 Richardson et al. ..... 417/292

FOREIGN PATENT DOCUMENTS 2927797 2/1981 Fed. Rep. of Germany ..... 417/292
55-96388 7/1980 Japan ..... 417/292
56-165793 12/1981 Japan ..... 417/292

*Primary Examiner*—Edward K. Look
*Attorney, Agent, or Firm*—Stevens, Davis, Miller & Mosher

[57] ABSTRACT

A compressor having a rotor, a cylinder rotatably accommodating the rotor, vanes slidably mounted on the rotor, side plates secured to both sides of the cylinder so as to close both open ends of cylinder chambers defined by the cylinder, rotor and the vanes, a suction port and a discharge port for a refrigerant, and a temperature-sensitive valve disposed in the passage communicating with the suction port and adapted to open and partially close the suction port. Representing the rotating angle of the rotor between the position at the beginning of the suction stroke and the position at completion of the suction stroke by $\theta_s$ rad., the volume of the cylinder chamber at the position of completion of the suction stroke by Vo cc, and the effective area of the suction passage between the evaporator and the cylinder chamber in the opening state of the temperature-sensitive valve by $a_2(\theta)$ cm$^2$; the means value $\bar{a}_2$ of the effective area is given as follows:

$$\bar{a}_2 = \int_0^{\theta_s} \theta^2 a_2(\theta) d\theta / \int_0^{\theta_s} \theta^2 d\theta$$

Similarly, the mean value $\bar{a}_1$ of the same effective area $a_1(\theta)$ cm$^2$ in the state where the temperature-sensitive valve is operating is given as follows:

$$\bar{a}_1 = \int_0^{\theta_s} \theta^2 a_1(\theta) d\theta / \int_0^{\theta_s} \theta^2 d\theta$$

The compressor is constructed to meet the following conditions:

$$0.025 < \theta_s \cdot a_1 / Vo < 0.080$$

and $$a_2 > a_1$$

In the steady state of operation, the refrigerating capacity is suppressed effectively due to a suitable selection of parameters constituting the compressor, whereas in the transient period requiring a large refrigerating capacity, the suppressing function is dismissed to provide good cooling down characteristics.

4 Claims, 25 Drawing Figures

COMPRESSOR

BACKGROUND OF THE INVENTION

The present invention relates to a rotary compressor and, more particularly, to the control of the refrigerating capacity in air conditioner incorporating a rotary compressor.

Ordinary sliding vane type rotary compressors are finding spreading use in recent years as compressors for automobile air conditioners because of their small size and simple construction as compared with reciprocating type compressors having a large number of parts and complicated construction. In comparison with the reciprocating type compressors, however, the rotary compressors suffer the following disadvantages.

When the rotary compressor is used as a compressor for an automobile air conditioner, the power of the engine is transmitted to the pulley of a clutch for driving the compressor, through a belt running between the engine shaft and the pulley of the clutch. Therefore, when the sliding vane type compressor is used as a compressor for automobile air conditioners, its refrigerating capacity is increased substantially in proportion to the speed of revolution of the engine.

On the other hand, in the conventionally used reciprocating type compressors, the follow-up characteristics of the suction valve is deteriorate at the high speed of operation of the compressor, resulting in an insufficient sucking of the refrigerant gas into the cylinder, so that the refrigerating capacity is saturated when the speed of operation of the compressor is increased beyond a predetermined speed. Namely, in the reciprocating type compressors, there is a function of automatically suppressing the refrigeration capacity during high speed operation of the engine. In the rotary compressors, however, such a function cannot be performed so that the efficiency is lowered due to an increase of the compression work or the air is cooled excessively.

As a measure for overcoming the above-described shortcoming of the rotary compressor, it has been proposed to employ a solenoid-operated control valve in the passage leading to the suction port formed in a side plate of the compressor, the control valve being adapted to restrict the area of opening of the passage during high speed operation of the compressor to cause a suction loss and thereby to effect control of the refrigerating capacity. This arrangement, however, necessitates an additional provision of the control valve, resulting in a complicated construction and raised cost of production of the compressor. As another measure for eliminating the above-described shortcoming of the rotary compressors, it has been proposed also to employ a fluid clutch or a planetary gear system adapted to prevent the speed of revolution of the compressor from increasing beyond a predetermined level.

The arrangement using the fluid clutch, however, suffers a large energy loss due to generation of heat in the relative moving surfaces of the clutch, while in the arrangement making use of the planetary gear system, the size of the compressor is increased undesirably due to the incorporation of the planetary gear system, quite contrary to the current demand for simple and compact construction of the compressor in view of requirement for saving of energy. For these reasons, these countermeasures have not been put into practical use successfully.

SUMMARY OF THE INVENTION

Under the circumstances, the present inventors have found out that self-suppression of refrigerating capacity can be achieved effectively also in rotary compressors equally to the case of reciprocating type compressors, by suitably selecting and combining the parameters such as area of suction port, discharge rate, number of vanes and so forth. This discovery has been accomplished as a result of minute study on the transient characteristics of the refrigerant pressure in the vane chamber, and a patent has been applied for on this technique as Japanese patent application No. 134048/1980.

By constructing the compressor to meet the conditions imposed by the above-mentioned invention, it is possible to produce an effective pressure loss only during high speed operation of the compressor while minimizing the loss of suction pressure in low speed operation, so that an effective control of refrigerating capacity can be achieved by a rotary compressor having simple construction without the aid of any specific additional part. This method of controlling the refrigerating capacity, however, cannot satisfactorily meet the demand for an automobile air conditioner considering that automobile air conditioners are used under a large variety of conditions. Namely, the optimum cooling rate is determined not only by the speed of operation of the engine but also by the environmental temperature and, hence, there are some cases where suppression of the refrigerating capacity is not necessary even during high speed running of the automobile. For instance, when the automobile is started after being left for a long time under the blazing sun, suppression of the refrigerating capacity is unnecessary. In such a case, rather, it is desired to obtain excessive refrigerating capacity.

The present invention aims at coping with the above-stated demand for an air conditioner incorporating a rotary compressor, by providing a rotary compressor which can be switched between an operation mode in which the control of refrigerating capacity is alive and another operation mode in which the function of control of refrigerating capacity is dismissed, by a suitable selection of parameters.

According to the invention, the refrigerating capacity is effectively suppressed during an ordinary state of running by suitable selection of parameters in constructing the compressor, whereas, in the transient state as stated before, the function for supressing the refrigerating capacity is dismissed by means of a temperature actuator which operates in response to, for example, the temperature of the refrigerant entering the compressor to obtain drastic cooling down characteristics of the compressor.

The rotary compressor of the invention is suitable for use requiring both excellent cooling down characteristics and saving of energy. A typical example of such a use is a rotary compressor for an automobile air conditioner.

Namely, the present invention aims as its object at providing the basic construction of a rotary compressor which satisfies the following demands:

1. The refrigeration capacity is effectively suppressed only during high speed operation, while no substantial loss of refrigeration capacity is caused during low speed operation of the compressor;

2. The function of suppressing the refrigerating capacity is automatically suppressed when a rapid cooling down of air is required.

BRIEF DESCRIPTION OF THE DRAWINGS

FIG. 12 is an illustration of an instrument for measuring the effective suction passage area a;

FIG. 14A is a graph similar to that in FIG. 14B in the case where the suction passage is closed in the later half part of the suction stroke;

DESCRIPTION OF THE PREFERRED EMBODIMENTS

Figure 1:
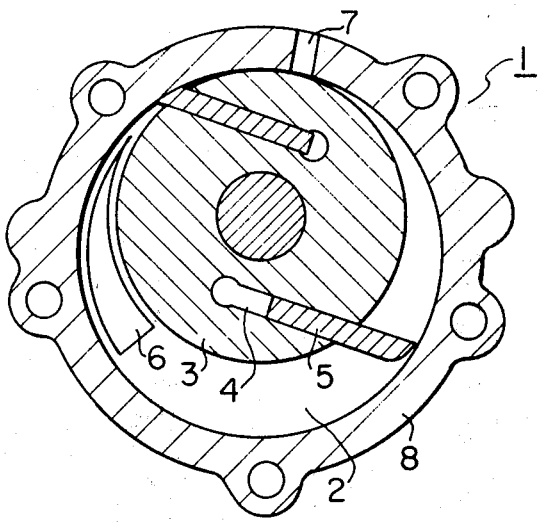
FIG. 1 is a front elevational sectional view of an ordinary sliding vane type rotary compressor.

Referring to FIG. 1, a typical conventional sliding vane type rotary compressor 1 has a cylinder 8 having an internal cylindrical space, side plates (not shown in FIG. 1) fixed to both sides of the cylinder 8 so as to close vane chambers 2 which constitute an internal space of the cylinder 8, a rotor 3 eccentrically disposed in the cylinder 8, and vanes 5 slidably received by grooves 4 formed in the rotor 3. Reference numeral 6 denotes a suction port formed in one of the side plates, while reference numeral 7 designates a discharge port formed in the cylinder 1. As the rotor 3 rotates, the vanes 5 are projected outwardly due to the centrifugal force to make sliding contact at their outer ends with the inner peripheral surface of the cylinder 8 to prevent internal leakage of the gas under compression.

Figure 2:
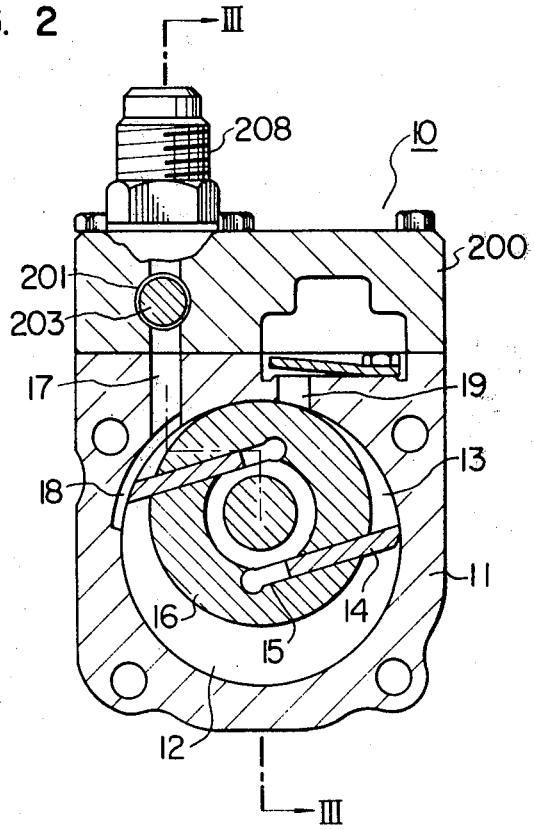
FIG. 2 is a front elevational sectional view of a rotary compressor in accordance with an embodiment of the invention, taken along the line II—II of FIG. 3.
Figure 3:
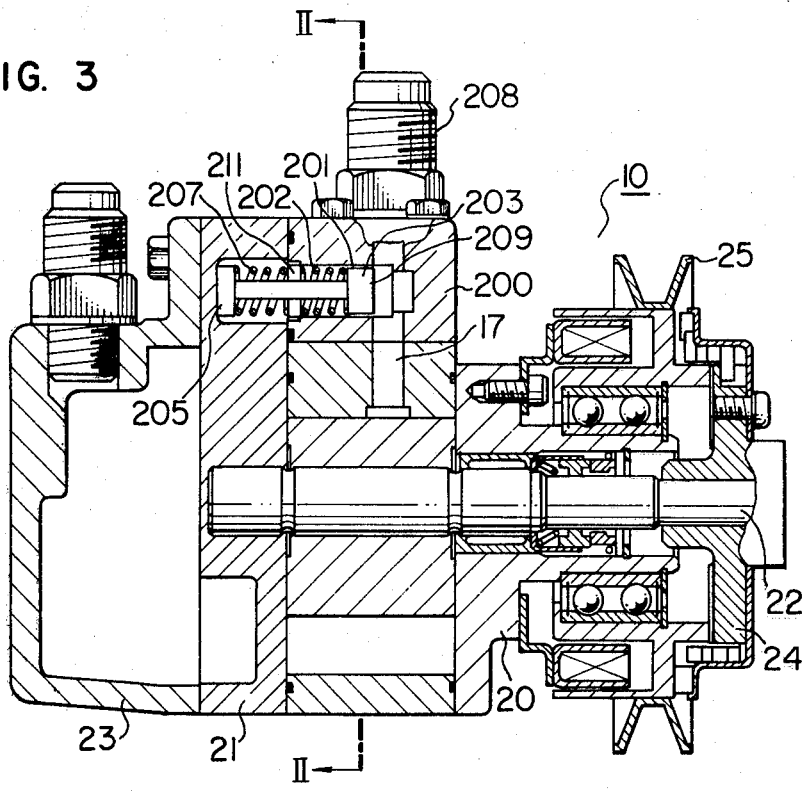
FIG. 3 is a side elevational sectional view of the carburetor shown in FIG. 2 taken along the line III—III of FIG. 2.

FIGS. 2 and 3 in combination show a sliding vane type rotary compressor in accordance with an embodiment of the invention. The compressor, generally designated at a reference numeral 10, has a cylinder 11, low-pressure vane chamber 12, high-pressure vane chamber 13, vanes 14, vane grooves 15, rotor 16, suction port 17, suction groove 18 formed in the inner peripheral surface of the cylinder 11 and a discharge port 19.

Referring now to FIGS. 3 and 4, the rotary compressor of the first embodiment further has a front panel 20 and a rear panel 21 which constitute the side plates to the compressor, rotor shaft 22, rear case 23, clutch disc 24 fixed to the rotor shaft, and a pulley 25. Reference numeral 200 denotes a head cover, 201 denotes a head sleeve formed in the head cover 200, 202 denotes a coiled spring accommodated by the sleeve 201 and made of a shape memorizing alloy, 203 denotes a suction side spool head, 204 denotes a shaft, 205 denotes a spool head of the rear case side, 206 denotes a sleeve portion of the rear case, 207 denotes a biasing spring received by the sleeve portion 206, 211 denotes a spring retainer fixed by means of screw to the head cover 200 and 208 denotes a pipe joint for connecting a suction pipe.

The above-mentioned members 203, 204, 205, 202, 207 and 211 in combination constitute a valve which controls the effective area of suction passage upon detection of the temperature of the refrigerant sucked into the compressor. More specifically, the members 203, 204 and 205 in combination form a spool 209 of the valve. Reference numeral 212 designates an upper passage, 210 denotes a valve passage and 213 denotes a lower passage. The passages 212, 210, 213 and the suction port 17 and the suction groove 18 in combination constitute a fluid passage between the suction pipe joint 208 and the vane chamber 12.

According to the invention, the coiled spring 202 made of a shape memorizing alloy, adapted to expand and shrink in response to changes in temperature, is disposed to oppose to the biasing spring 207 such that the position of the spool is determined by the balance of force between two springs. In consequence, the flow rate of refrigerant is controlled in accordance with a change in the temperature of the refrigerant sucked into the compressor. The rotary compressor of the first embodiment is designed and constructed in accordance with the specifications shown in Table 1.

In Table 1, the term "sucking condition I" is used to represent the condition of sucking of refrigerant in the steady running state of the automobile, while the term "sucking condition II" is used to mean the condition of sucking of refrigerant in the state immediately after the start up of the automobile.

In the described embodiment, the sucking condition I is selected such that the temperature $T_A$ of the refrigerant sucked into the compressor falls within the range shown below.

$$-5° C. < T_A < 15° C.$$

Figure 4A:
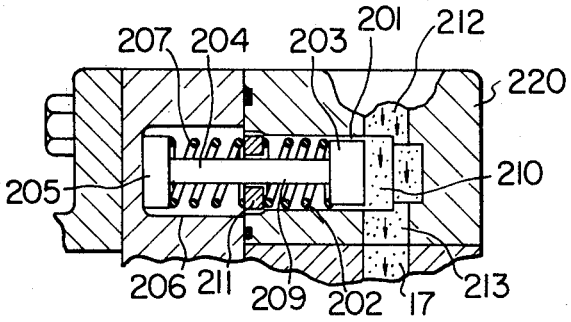
FIG. 4A is an illustration of a valve in the opened state.
Figure 4B:
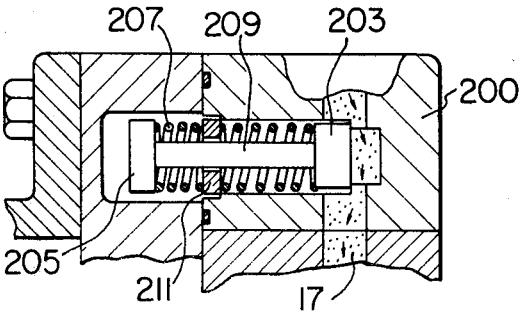
FIG. 4B is a sectional view of the valve of the state restricting a passage.

FIG. 4B shows the state of the valve under the sucking condition I. In this case, the coiled spring 202 takes an expanded state because the temperature of the refrigerant sucked into the compressor is comparatively low.

TABLE 1

| Parameters | | Symbols | Embodiment |
|---|---|---|---|
| Number of vanes | | n | 2 |
| Effective area of suction passage | Sucking conditions (I) | $a_1$ | 0.450 $cm^2$ |
| | Sucking condition (II) | $a_2$ | 1.2 $cm^2$ |
| Theorectical discharge rate | | V th | 86 cc/rev |
| Angular position of vane at which sucking is completed | | θs | 270° |
| Cylinder width | | b | 40 mm |
| Cylinder inner dia. | | Rc | 33 $mm^R$ |
| Rotor radius | | Rr | 26 $mm^R$ |

The compression spring 207 is accommodated by the valve in the compressed state. However, since the strength of the compression spring 207 is sufficiently smaller than that of the coiled spring 202, the spool 209 is moved to the right to restrict the valve passage 210 as shown in FIG. 4B. In the described embodiment, various parameters of the compressor are selected suitably to effect an appropriate refrigerating capacity control under the condition stated above, as will be described later in detail.

The sucking condition II is the condition in the transient period of 5 to 10 minutes from the start up of the automobile after being left for long time in the blazing sun.

FIG. 4A shows the state of the valve under the above-mentioned sucking condition II. Since the temperature of the refrigerant sucked into the compressor is high, the coiled spring made of shape memorizing alloy takes the contracted state, so that the spool 209 has been moved to the left by the bias of the compression spring 207.

Namely, in the state where the temperature of the sucked refrigerant is high, the valve passage 210 is kept opened as shown in FIG. 4A, so that the vane chamber is supplied with the refrigerant at a sufficiently large rate even when the compressor is operating at high speed, so that the refrigerating capacity is not suppressed substantially.

The shape memorizing alloy as used in this embodiment is a known alloy which recovers, when heated to a level above the critical temperature peculiar to the alloy after a plastic deformation at a lower temperature, the original shape possessed at the higher temperature. More specifically, in this alloy, plastic deformation is imparted at a temperature below martensite transformation temperature while heating is made up to a temperature above a temperature at which the reverse transformation is completed. The shape memorizing effect, i.e. the function of recovering the original shape, is made by a reversible recovery of the transformed martensite structure into the matrix phase.

Therefore, in the arrangement shown in FIGS. 4A and 4B, the coiled spring 202 made of a shape memorizing alloy has been shaped to take the most contracted state at high temperature, e.g. 15° to 20° C., above the temperature of completion of reverse transformation.

There are two types of shape memorizing alloy: namely, a heat elasticity type and a superlattice type. It is found that the shape memorizing alloy of heat elasticity type, in which the difference between the temperature at the start of the martensite transformation and the temperature at the start of the reverse transformation is as small as several tens of degrees by centigrade, can control the rate of sucking of the refrigerant to the compressor for an automobile air conditioner in quite an adequate manner.

Figure 7:
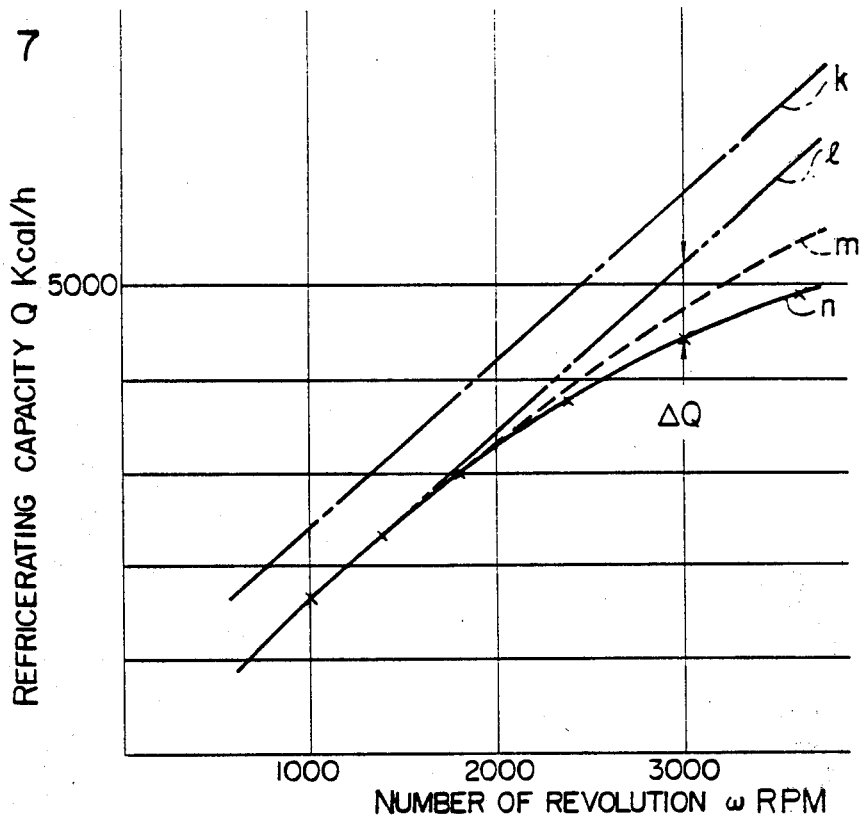
FIG. 7 is a graph showing the refrigerating capacity Q in relation to the speed of revolution of the compressor actually measured with the compressor of the invention shown in FIG. 2 in comparison with that measured with a conventional compressor.

FIG. 7 shows the result of measurement of the refrigerating capacity in relation to the speed of revolution in the compressor of the invention constructed in accordance with the specifications shown in Table 1. The measurement was made using a secondary refrigerant type calorimeter under the conditions shown in Table 2.

TABLE 2

| Parameters | Symbol | Values in embodiment |
|---|---|---|
| Refrigerant pressure at supply side | Ps | 3.18 $Kg/cm^2$ abs |
| Refrigerant temperature at supply side | $T_A$ | 283° K. |
| Refrigerant pressure at discharge side | $P_d$ | 15.51 $Kg/cm^2$ abs |
| Speed of revolution | ω | 600 to 5000 rpm |

In FIG. 7, the characteristic curve k represents the refrigeration capacity which is determined by the theoretical discharge rate when there is no loss of refrigerating capacity, while the characteristic curve l shows an example of the refrigerating capacity characteristics of a conventional rotary compressor. The characteristics shown by the curve l correspond to the case where the effective suction passage area is sufficiently large, i.e. to the sucking condition II in Table 1. The characteristic curve m shows the characteristics of an example of conventional reciprocating type compressors, while the characteristic curve n shows the characteristics performed by the compressor of the invention when the latter is set for the sucking condition I in Table 1.

Figure 8:
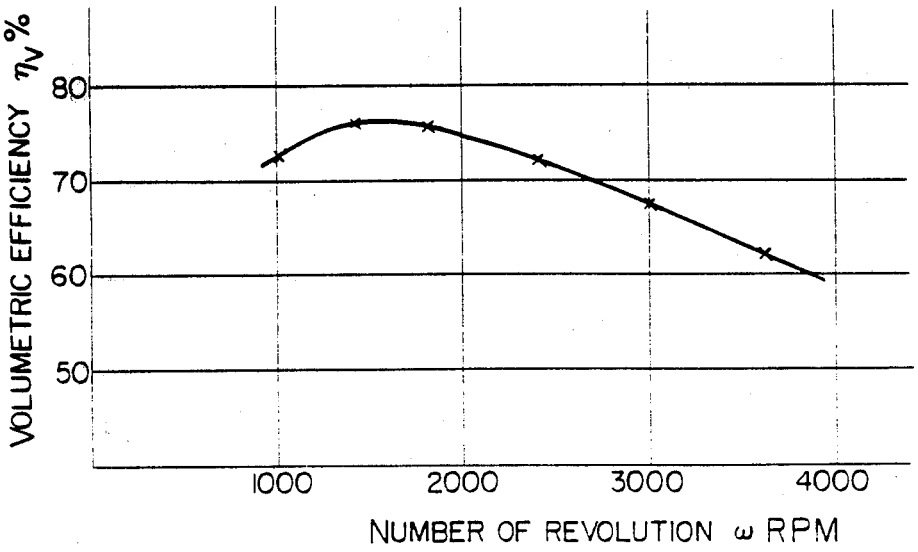
FIG. 8 is a graph showing the volumetric efficiency $\eta v$ of the compressor shown in FIG. 2 actually measured in relation to speed of revolution $\omega$.

FIG. 8 shows the actually measured volumetric efficiency ηv of the compressor of the invention when the latter is set for the sucking condition I.

The compressor of the invention exhibits ideal refrigerating capacity characteristics as shown by the curve n in FIG. 7, in contrast to the common sense of the technical field concerned that excessive refrigerating capacity is inevitable in high speed operation of a rotary compressor.

The following advantageous features were confirmed:

(i) The reduction of refrigerating capacity due to suction loss at low speed of revolution was negligibly small. Although a decrease of volumetric efficiency is observed at the speed region below 1400 rpm in FIG. 8, the decrease is attributable to internal leakage of the fluid across the sliding portions in the compressor. The conventionally used reciprocating type compressor has an advantage in that the suction loss is very small at a low speed of operation of the compressor. The rotary compressor of this embodiment showed an extremely small suction loss at low speed, which compares well with that of the reciprocating type compressor. This will be realized from the fact that the characteristic curves l and m in FIG. 7 overlap each other in the low speed region of operation of the compressor.

(ii) A refrigerating capacity suppressing effect which is equivalent to or greater than that achieved by the reciprocating type compressor was obtained in high speed operation of the compressor.

(iii) The refrigerating capacity suppressing effect becomes appreciable when the speed of revolution is increased to 1800 to 2000 rpm or higher. This means that the rotary compressor permits the design and construction of an ideal refrigeration cycle having good energy saving characteristics and favourable feeling of drive, when used as the compressor of an automobile air conditioner.

The features (i) to (iii) described above are quite advantageous and favourable for the refrigeration cycle of automobile air conditioners.

The total weight of the refrigerant sucked into the vane chamber, and hence the compression, work can be reduced by the drop of suction pressure and specific weight of the refrigerant in the polytropic change performed by the compressor during the suction stroke. Therefore, the compressor of the invention, which causes an automatic reduction of the total weight of refrigerant in advance of the compression stroke, automatically reduces the driving power at a high speed of operation of the compressor.

In the field of room air conditioners, for example, such a refrigerating capacity controlling method has been put into practical use as selectively opening a control valve connected between the high-pressure side and low-pressure side of the compressor to permit the pressurized refrigerant to be partially returned to the low-pressure side of the compressor, thereby to prevent any excessive cooling. This controlling method, however, has a drawback in that the efficiency of the refrigeration cycle is lowered due to a compression loss caused by the re-expansion of the refrigerant gas returned to the low-pressure side.

In the case of compressors used in automobile air conditioners, the frequency of use under the sucking condition I is much higher than the frequency of use under the sucking condition II. It is, therefore, remarkable that the rotary compressor of the invention makes it possible to design and construct an energy saving and highly efficient automobile air conditioner, thanks to the possibility of refrigerating capacity control without requiring any wasteful mechanical work which causes a compression loss.

As will be understood from the data shown by the curve l in FIG. 7, the refrigerating capacity in the conventional rotary compressor is increased linearly in proportion to the speed of revolution of the rotor of the compressor. This feature has been considered as being one of the drawbacks of rotary compressors. However, according to the invention, this feature does not constitute any drawback but, rather, this feature is utilized positively as an advantage. According to the invention, it is possible to obtain superior cooling down characteristics at high speed of operation of the compressor under the sucking condition II.

The refrigerant is circulated at a considerably high rate through the compressor. For instance, the flow rate Q is as large as 86 cc per revolution of the compressor rotor. However, according to the invention, it is possible to minimize the suction loss under the condition which requires no control of refrigerating capacity, i.e. under the sucking condition II because, under such condition, it is possible to preserve a sufficiently large diameter of the fluid passage as shown in FIGS. 4A and 4B, thanks to the use of the shape memorizing alloy which provides a sufficiently large stroke of the spool.

In the described embodiment, a temperature-sensitive material such as the shape memorizing alloy constitutes a temperature-responsive actuator which is disposed at the suction side of the compressor and operates by itself upon detection of the refrigerant temperature at the outlet from the evaporator. This arrangement, however, requires only a few additional parts such as the parts 202, 207, 211 and 209 as compared with conventional rotary compressors. Thus, according to the invention, it is possible to obtain a rotary compressor having not only the function of suppressing the refrigerating capacity but also the function of dismissing such suppression, without losing the advantages of the rotary compressors, i.e. small size, light-weight and simple construction.

As stated before, in the described embodiment, the compressor is constructed to permit an adequate refrigerating capacity control when the compressor operates under the sucking condition I. A detailed description will be made hereinunder in this connection.

Figure 5A:
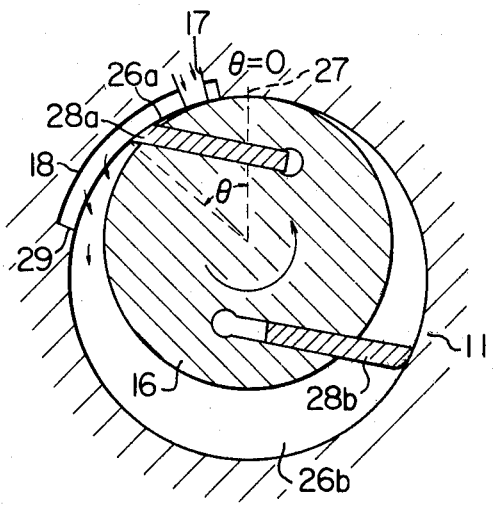
FIG. 5A is an illustration of positions of vanes and rotor in the state immediately after the start of the suction stroke.
Figure 5B:
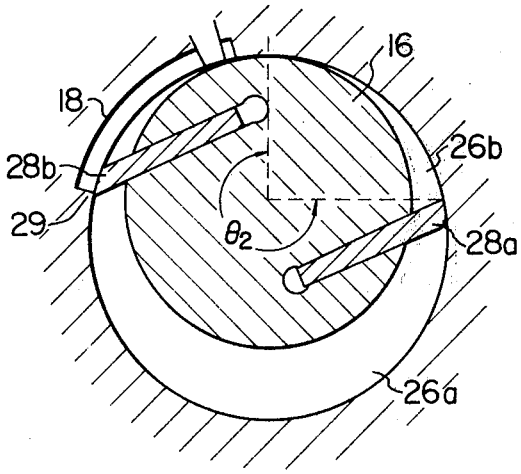
FIG. 5B is an illustration of positions of vanes and rotor in the state of completion of the suction stroke.

The angular position $\theta_s$ of a vane at which vane end completes the sucking, appearing in Table 1, is defined as follows. Referring to FIGS. 5A and 5B, reference numerals 26*a* and 26*b* denote vane chambers, 27 denotes the top portion of the cylinder 11, 28*a* and 28*b* denote vanes and 29 denotes the end of the suction groove.

With the center located at the axis of rotation of the rotor 16, the angular position of the vane is expressed by the angle $\theta$ formed between the position where the vane end passes the top portion 27 of the cylinder 11 and the instant position of the vane end. Thus, when the vane end passes the top portion 27 of the cylinder 11, the angular position of the vane is expressed by $\theta=0$. As to the vane chamber 26*a*, FIG. 5A shows the state immediately after the start of the suction stroke, because the vane 28*a* has just passed the suction port 17. In this state, the vane chamber 26*a* is supplied with the refrigerant directly through the suction port 17 while the other vane chamber 26*b* is supplied with the refrigerant indirectly through the suction groove 18 as indicated by arrows.

FIG. 5B shows the state immediately after the completion of the suction stroke with the vane chamber 26*a*. In this state, the end of the vane 28*b* is positioned on the end 29 of the suction groove 18. At this moment, the vane chamber 26*a* defined by the vanes 28*a* and 28*b* takes the maximum volume.

Figure 6A:
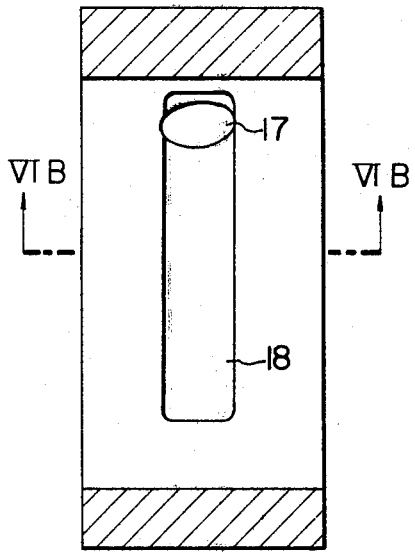
FIG. 6A is a sectional view showing the configuration of the suction port of the compressor shown in FIG. 2.
Figure 6B:
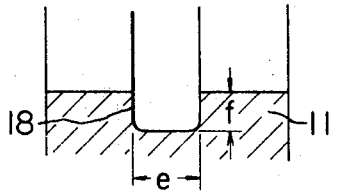
FIG. 6B is a sectional view taken along the line VIB—VIB of FIG. 6A.

In the described embodiment, the suction groove 18 is formed in the inner peripheral surface of the cylinder 11 in a manner shown in FIGS. 6A and 6B. Namely, the suction groove, suction port and the control valve are so designed and constructed that, when the end of the vane 28*a* passes the suction groove 18 as shown in FIG. 5A, the valve passage 210 under the sucking condition II provides the minimum cross-sectional area in the refrigerant passage between the suction pipe (not shown) and the vane chamber 26b. Namely, the suction groove was formed to a sufficiently large depth such that the area $S_1$ of the suction groove given by $S_1=e\times f$ meets the condition of $S_1>a_1$.

Hereinunder, an explanation will be made as to an analysis which was conducted to minutely grasp the transient characteristics of the refrigerant pressure which constitutes an important feature of the invention.

The transient characteristics of the refrigerant pressure in the vane chamber are expressed by the following formula (1).

$$\frac{Cp}{A}GT_A - Pa\frac{dVa}{dt} + \frac{dQ}{dt} = \frac{d}{dt}\left(\frac{Cv}{A}\gamma aVaTa\right) \quad (1)$$

In formula (1) above, G represents the flow rate of refrigerant in terms of weight, Va represents the volume of vane chamber, A represents the thermal equivalent of work, Cp represents the specific heat at constant pressure, $T_A$ represents the refrigerant temperature at supply side, K represents the specific heat ratio, R represents the gas constant, Cv represents the specific heat at constant volume, Pa represents the pressure in the vane chamber, Q represents the calorie, $\gamma a$ represents the specific weight of refrigerant in the vane chamber and Ta represents the temperature of refrigerant in the vane chamber. At the same time, in the following formulae (2) to (4), a represents the effective suction passage area, g represents the gravity acceleration, $\gamma A$ represents the specific weight of refrigerant at the supply side and Ps represents the refrigerant pressure at the supply side.

In formula 1, the first term on the left side represents the heat energy of refrigerant brought into the vane chamber past the suction port per unit time, the second term represents the work performed by the refrigerant pressure per unit time and the third term represents the heat energy introduced from outside through the wall per unit time. On the other hand, the right side of the formula represents the increase of internal energy of the system per unit time. Assuming that the refrigerant follows the law of ideal gases and that the suction stroke of the compressor is achieved in quite a short time as an adiabatic change, the following formula (2) is derived from formula (1) using the relationship of $\gamma a=Pa/RTa$, $dQ/dt=0$.

$$G = \frac{dVa}{dt}\left(\frac{A}{CpT_A} + \frac{1}{kRT_A}\right)Pa + \frac{Va}{kRT_A}\frac{dPa}{dt} \quad (2)$$

Also, the following formula (3) is obtained by using the relationship of $$\frac{1}{R} = \frac{A}{Cp} + \frac{1}{kR}\cdot G = \frac{1}{RT_A}\cdot\frac{dVa}{dt}\cdot Pa + \frac{Va}{kRT_A}\frac{dPa}{dt} \quad (3)$$

The known theory of nozzles can be applied to the flow rate by weight of the refrigerant passing the suction port, so that the following equation (4) is derived.

$$G = a\sqrt{2g\gamma_A Ps\frac{k}{k-1}\left[\left(\frac{Pa}{Ps}\right)^{\frac{2}{k}} - \left(\frac{Pa}{Ps}\right)^{\frac{k+1}{k}}\right]} \quad (4)$$

It is, therefore, possible to obtain the transient characteristics of the pressure Pa in the vane chamber, by solving the formulae (3) and (4) in relation to each other. The volume $Va(\theta)$ of the vane chamber can be obtained through the following formula (5) in which m represents the ratio Rr/Rc.

$$V(\theta) = \frac{bRc^2}{2}\left\{(1-m^2)\theta + \frac{(1+m)^2}{2}\sin 2\theta - (1-m)\sin\theta\times\sqrt{1-(1-m)^2\sin^2\theta} - \sin^{-1}[(1-m)\sin\theta]\right\} + \Delta V(\theta) \quad (5)$$

Thus, the volume $Va(\theta)$ is represented by $Va(\theta)=V(\theta)$ when the angular position $\theta$ of the vane falls within the region of $0<\theta<\pi$ and by $Va(\theta)=V(\theta)-V(\theta-\pi)$ when the angular position falls within the range of $\pi<\theta<\theta s$.

Figure 9:
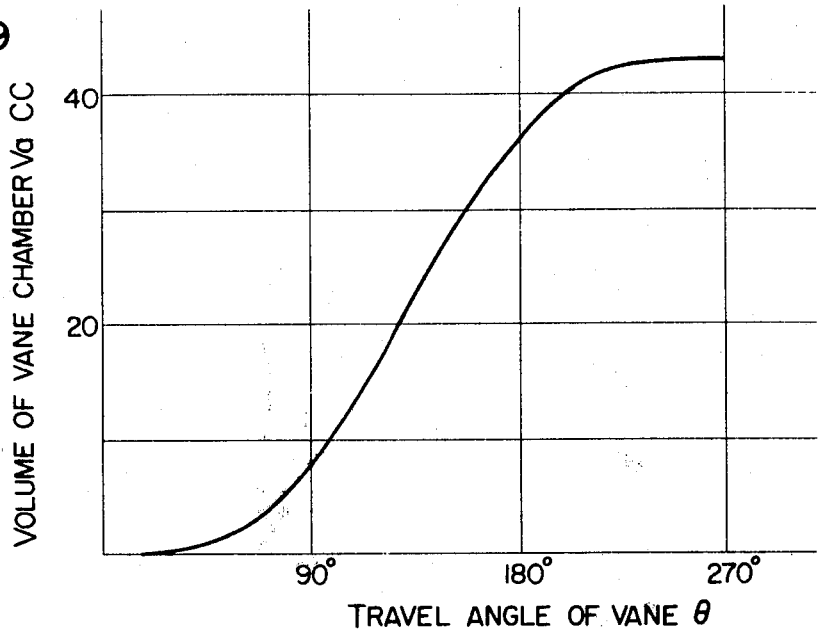
FIG. 9 is a graph showing the relationship between the angular position $\theta$ of the vane and the volume Va of the vane chamber in the compressor shown in FIG. 2.

The term $\Delta V(\theta)$ is a compensation term for compensating for the influence of eccentric arrangement of vanes relatively to the center of the rotor. The value of this term, however, is generally as small as 1 to 2%. FIG. 9 shows the characteristics as obtained when this term $\Delta V(\theta)$ is zero.

Figure 10:
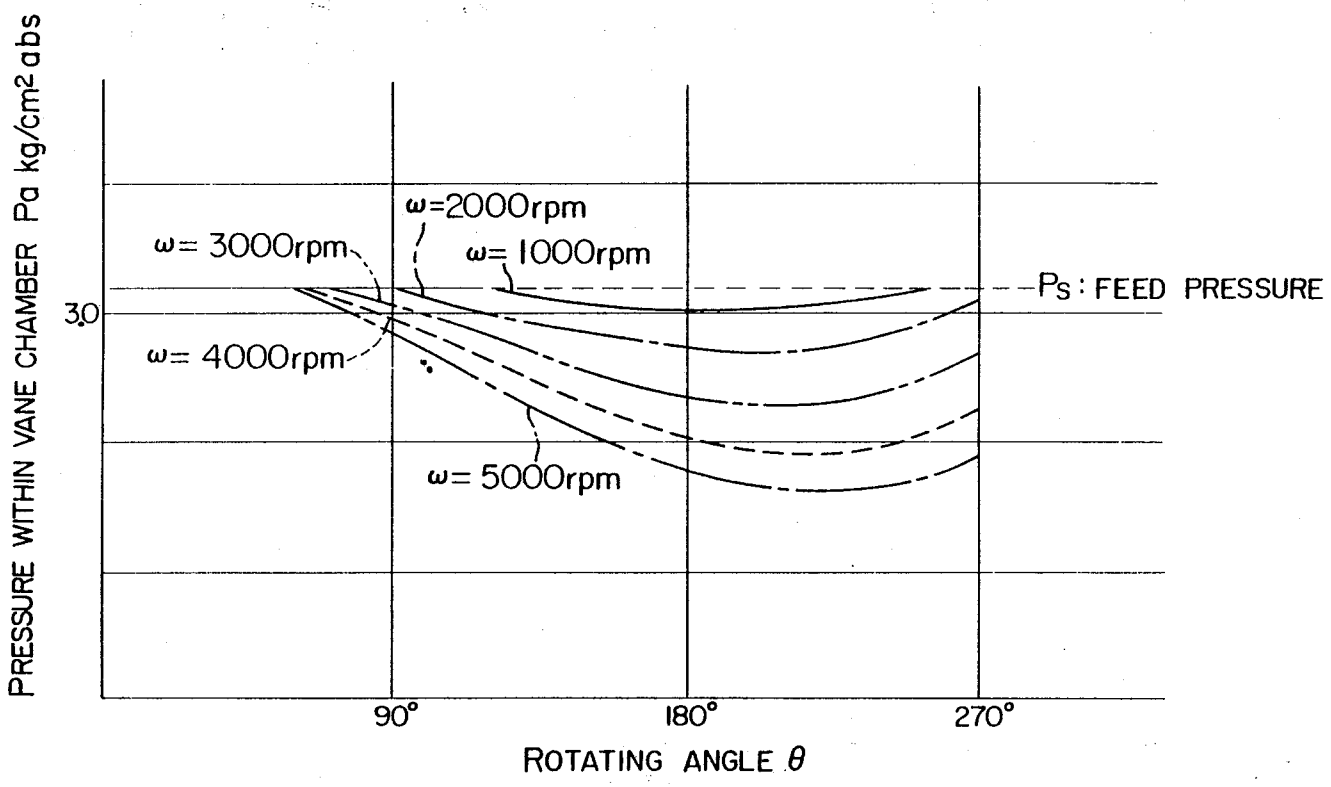
FIG. 10 is a graph showing an example of transient characteristics of the compressor shown in FIG. 2.

FIG. 10 shows the transient characteristics of the pressure in the vane chamber as obtained through the formulae (3) and (4) with numerical data specified in Tables 1 and 2 and under the initial condition of $t=0$ and $Pa=Ps$, using the speed of revolution as the parameter. Since freon R12 is usually used as the refrigerant of automobile air conditioners, the analysis was made on the assumption of $k=1.13$, $R=668$ Kg·cm/°Kkg, $\gamma A=16.8\times10^{-6}$ Kg/cm$^3$ and $T_A=283°$ K.

Referring to FIG. 10, the pressure Pa in the vane chamber has reached the level of the supply pressure of $Ps=3.18$ Kg/cm$^2$ abs when the vane is moved to the angular position of $\theta=260°$ which is the point before the completion of the suction stroke, so that no substantial loss of pressure in the vane chamber is caused at the moment of completion of the suction stroke.

However, as the speed of revolution is increased, the supply of the refrigerant begins to fail to follow up the change of volume in the vane chamber, so that the pressure loss at the point of completion of the suction stroke ($\theta=270°$) is gradually increased. For instance, a pressure loss of $P=1.37$ Kg/cm$^2$ is caused from the supply pressure Ps when the speed of revolution $\omega$ is 4000 rpm. In consequence, the total weight of the sucked refrigerant is lowered to remarkably lower the refrigerating capacity.

The formula (5) for determining the volume Va of the vane chamber can be approximated as follows.

Representing the maximum suction volume by Vo and transforming the angle $\theta$ into $\phi$ using a relationship of $\phi=Qt=(\pi\omega/\theta_s)t$, the following formula (6) is obtained.

$$Va(\phi) \approx \frac{Vo}{2}(1 - \cos\phi) \quad (6)$$

In the formula (6) above, $\phi$ is varied between 0 and $\pi$, so that $Va(\phi)$ and $Va'(\phi)$ is represented by $Va(0)=0$ and $Va'(0)$ at the moment $t=0$ and, at the moment $t=\theta_s/\omega$ at which the suction stroke terminates, $Va(\phi)$ and $Va'(\phi)$ take the values of $Va(\pi)=Vo$ and $Va'(\pi)=0$, respectively.

The following formula (7) is obtained by expressing the ratio Pa/Ps by $\eta$:

$$G = \frac{\Omega Vo}{2} \frac{Ps}{RT_A}\left\{ \sin\phi \cdot \eta + \frac{1}{k}(1 - \cos\phi)\frac{d\eta}{d\phi} \right. \quad (7)$$

Also, the formula (4) can be transformed into the following formula (8):

$$G = a\sqrt{Ps \cdot \gamma_A 2g \cdot \frac{k}{k-1}\left[\eta^{\frac{2}{k}} - \eta^{\frac{k+1}{k}}\right]} \quad (8)$$

Therefore, the following formula (9) is derived from the formulae (7) and (8) above:

$$K_1 f(\eta) = \sin\phi \cdot \eta + \frac{1}{k}(1 - \cos\phi)\frac{d\eta}{d\phi} \quad (9)$$

The factor $K_1$ is a value having no dimension, expressed by the following formula (10):

$$K_1 = \frac{2a\theta_s}{Vo\pi\omega} \cdot \sqrt{2gRT_A} \quad (10)$$

In the case of the sliding vane type rotary compressor, the following relationship exists between the number of vanes n and the theoretical discharge rate Vth:

$$Vth = n \times Vo$$

The formula (10), therefore, can be transformed into the following formula (11):

$$K_1 = \frac{2a\theta_s n}{Vth\pi\omega} \sqrt{2gRT_A} \quad (11)$$

In the formula (9) above, the specific heat ratio K is determined solely by the kind of the refrigerant. Therefore, under the condition in which the factor $K_1$ takes a constant value, the solution of the formula (9), i.e. $\eta=\eta(\phi)$, is determined definitely. This means that the loss of pressure of refrigerant in the vane chamber is equal in all compressors having an equal value of the factor $K_1$. Namely, the refrigerating capacity control can be effected at the same rate to the refrigerating capacity Q Kcal obtained when there is no loss, in the compressors having an equal value of the factor $K_1$.

Representing the pressure Pa in the vane chamber at the time of completion of the suction stroke by Pa=Pas, the rate of pressure drop $\eta p$ is defined as follows.

$$\eta p = \left(1 - \frac{Pas}{Ps}\right) \times 100 \quad (12)$$

Figure 11:
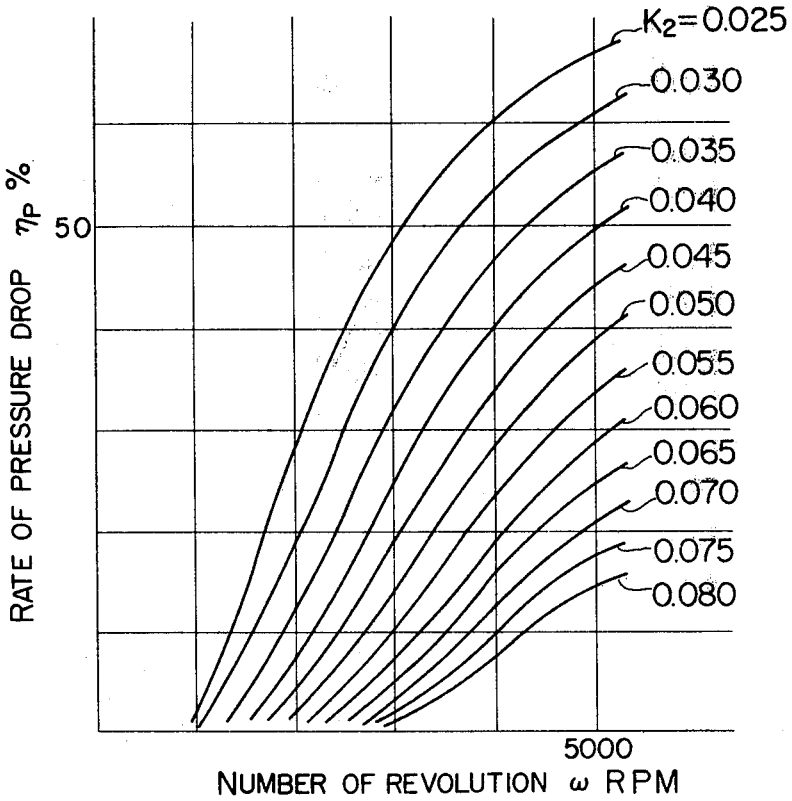
FIG. 11 is a graph showing the rate of pressure drop $\eta p$ in relation to the speed of revolution $\omega$ of the compressor.

FIG. 11 shows the rate of pressure drop $\eta p$ obtained through solving the formulae (3) to (5) on the assumption of $T_A=280°$ K. and assuming a superheat of T=10 deg, using a parameter of $$K_2 = \frac{a\,\theta_s}{Vo}.$$

As will be understood from FIG. 11, it is possible to obtain such an operation characteristic that the pressure loss is minimized at low speed operation and the pressure loss is effectively caused only at a high speed of operation of the compressor, by suitably selecting the parameters of the compressor. Thus, the pressure loss characteristic in relation to the speed of revolution involves a zone which is to be expressed as a "dead zone" in the region of low operation speed. The presence of this dead zone is the most important feature for attaining the effective refrigerating capacity control in the rotary compressor of the invention.

The parameter $K_2$ is calculated as follows from the data specified in Table 1 under the sucking condition I:

$$K_2 = \frac{0.450 \times 4.71}{43} \times 0.0493$$

The rate of pressure drop $\eta p$ at the speed of $\omega=3000$ rpm is calculated to be $\eta=15\%$ when the factor $K_2$ takes the value derived as above. The rate of pressure drop can be regarded as being materially equivalent to the rate of reduction of the refrigerating capacity.

In the test result as shown in FIG. 7, the rate of reduction of refrigerating power is 16.0% which substantially coincides with the calculated value of the rate of pressure drop $\eta p$.

A test was conducted using an actual automobile. The test result showed that the practically satisfactory refrigeration cycle for an automobile air conditioner is obtained if the refrigerating capacity control characteristics satisfy, for example, the following requirements:

(i) The rate of reduction of refrigerating capacity, i.e. the rate of pressure loss, should be less than 5% at the speed of revolution $\omega=1800$ rpm;

(ii) The rate of reduction of refrigerating capacity should be at least 10% at the speed of revolution $\omega=3600$ rpm.

In order to meet both of these requirements simultaneously, the factor $K_2$ should be selected to meet the following condition:

$$0.040 < K_2 < 0.075 \quad (13)$$

Therefore, it is possible to obtain a compressor having a capacity controlling function meeting both of the requirements (i) and (ii), by selecting the parameters $a, \theta_s$, n and Vth in such a manner as to satisfy the formula (13). The value of the factor $K_2$ in formula (13), however, is a value obtained on the assumption that the refrigerant temperature $T_A$ is 283° K. Thus, the range of the value of factor $K_2$ is changed, although not substantially, depending on the selection of the referigerant temperature.

When freon R12 is used as the refrigerant in a refrigeration cycle of an automobile air conditioner, the evaporating temperature $T_A$ of the refrigerant is determined taking the following matters into account.

The rate of heat exchange in the evaporator is greater as the temperature difference between the external air and the circulated refrigerant is increased. It is, therefore, preferred to lower the refrigerant temperature $T_A$. However, if the refrigerant temperature is set at a level below the freezing point of moisture in the air, the moisture in the air is inconveniently frozen on the pipe to seriously affect the heat exchange efficiency. Therefore, it is preferable to set the refrigerant temperature at such a level as to provide a pipe surface temperature above the freezing point of the moisture in the air. The best set temperature $T_A$ of the refrigerant is around −5° C. provided that the air is allowed to flow at a sufficiently large flow rate, and the practically acceptable lower limit of the set temperature $T_A$ of the refrigerant is around −10° C. The evaporation temperature of the refrigerant is higher during low-speed running of the automobile or during idling in which the condition for heat exchange is rather inferior. The rate of heat exchange can be increased by increasing the flow rate of air by increasing the power of the blower or, alternatively, through increasing the surface area of the evaporator. These measures, however, are practically limited mainly for the reason of installation. Therefore, the practically acceptable upper limit of the refrigerant temperature $T_A$ is around 10° C. More preferably, the refrigerant temperature is maintained below 5° C. Thus, for obtaining a practically acceptable refrigeration cycle, the refrigerant temperature $T_A$ should be selected to meet the following condition:

$$-10^\circ\ C. < T_A < 10^\circ\ C. \tag{14}$$

For information, the refrigerant supply pressure Ps meeting the above-specified condition is calculated as follows:

$$2.26\ Kg/cm^2abs < Ps < 4.26\ Kg/cm^2abs \tag{14'}$$

Furthermore, superheat $\Delta T = 10$ deg is taken into account relative to $T_A$ of formula (14):

$$0^\circ\ C. < T_A < 20^\circ\ C. \tag{15}$$

It is, therefore, possible to correct the region of the factor $K_2$ determined, for example, by formula (13). Thus, it is required only to make a correction to cause 1.8% increase of the upper limit value of the factor $K_2$ and 1.7% decrease of the lower limit value of the same.

In the present invention, the effective area of suction passage is a concept as explained below.

The approximate value of the effective area of suction passage a can be grasped as a value which is a multiple of the minimum cross-sectional area in the fluid passage between the evaporator outlet and the vane chamber and a contracting coefficient C which is generally between 0.7 and 0.9, if such a minimum cross-section exists in the fluid passage. More strictly, however, the value obtained through experiments conducted following a method specified in, for example JIS B 8320 is defined as the effective area of the suction passage.

Figure 12:
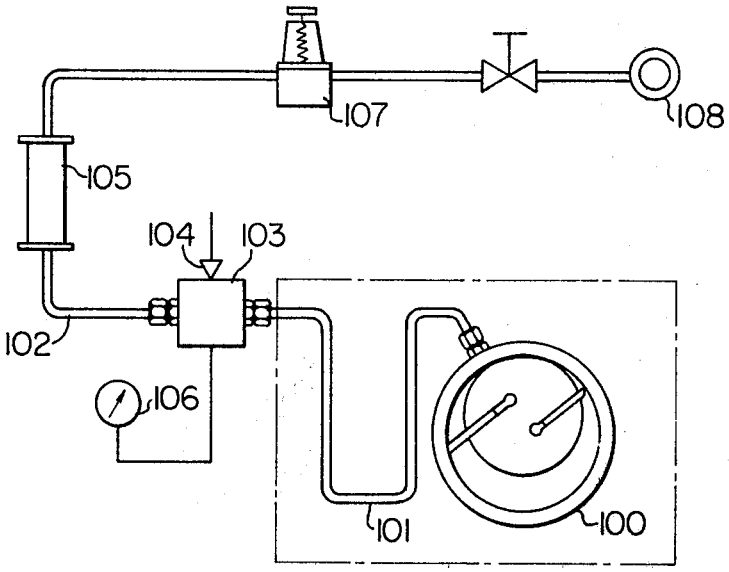

FIG. 12 shows an example of such experiments. In FIG. 12, reference numeral 100 denotes a compressor, 101 denotes a pipe for connecting the evaporator to the suction port of the compressor when the evaporator and the compressor are mounted on an actual automobile, 102 denotes a pipe for supplying pressurized air, 103 denotes a housing for connecting the pipes 101 and 102 to each other, 104 denots a thermocouple, 105 denotes a flow meter, 106 denotes a pressure gauge, 107 denotes a pressure regulator valve and 108 denotes a source of the pressurized air.

The section surrounded by one-dot-and-dash line in FIG. 12 corresponds to the compressor of the invention. However, if there is any restricting portion which imposes an nonnegligible flow resistance in the evaporator, it is necssary to add a restriction corresponding to such restricting portion to the pipe 101.

For measuring the effective area of suction passage a of the compressor having the construction as shown in FIG. 2, the experiment is conducted while setting the spool 209 at the position for the sucking condition I or the sucking condition II, with the disc and pulleys 24, 25 of the clutch demounted and with the front panel 20 detached from the cylinder 11.

The effective area of suction passage a is determined by the following formula (16), representing the pressure of the pressurized air by $P_1$ Kg/cm² abs, atmospheric pressure by $P_2 = 1.03$ Kg/cm² abs, specific heat ratio of air by $K_1 = 1.4$, specific weight of air by $\gamma_1$ and the gravity acceleration by $g = 980$ cm/sec².

$$a = G_1 / \sqrt{2g\gamma_1 P_1 \frac{k}{k_1 - 1}\left\{\left(\frac{P_2}{P_1}\right)^{\frac{2}{k_1}} - \left(\frac{P_2}{P_1}\right)^{\frac{k_1+1}{k_1}}\right\}} \tag{16}$$

The pressure $P_1$ of the pressurized air should be selected to meet the condition $0.528 < P_2 < P_1 < 0.9$.

An experiment was conducted with actual automobiles mounting compressors having different values of the factor $K_2$, the result of which is shown in Table 3.

The experimental data shown in FIG. 7 have been obtained on the assumption that the suction pressure $P_s$ and the discharge pressure Pd are constant. In actual use on a running automobile, however, the suction pressure is lowered and the discharge temperature is increased at a high speed of revolution of the compressor rotor.

Therefore, if there is no function of control of the refrigerating capacity, not only is the compressor work (driving torque) increased due to an increase of the compression ratio, but also the condenser is overloaded due to high discharge temperature. In the worst case, the air conditioner is broken due to the overload on the condenser. The margin against the overload becomes greater as the capacity and, hence, the size of the condenser are increased. Therefore, the margin against excessive refrigerating capacity is greater in automobiles having greater size, because such automobiles can mount condensers of greater size.

TABLE 3

| Speed of revolution | Effect of refrigerating capacity control (pressure reduction rate) | $K_2$ | Test result |
|---|---|---|---|
| 1800 | 22.5% | 0.025 | Efficiency somewhat |

TABLE 3-continued

| Speed of revolution | Effect of refrigerating capacity control (pressure reduction rate) | $K_2$ | Test result |
|---|---|---|---|
| rpm | | | lowered at low speed but sufficient refrigerating capacity obtainable provided that compressor used has theoretical volume of Vth = 95 cc/rev. or greater. |
| | 9.0 | 0.036 | Practically sufficient althought there is small loss of efficiency. |
| | 4.5 | 0.040 | Small reduction of efficiency. Possible to design ideal energy saving refrigeration cycle of high efficiency. |
| 4600 rpm | 21.5 | 0.065 | Best capacity controlling and energy saving effects at high speed obtained. |
| | 18.0 | 0.070 | Effect substantially equivalent to conventional reciprocating compressor obtained. Practically sufficient performance assured. |
| | 12.0 | 0.080 | Capacity controlling effect somewhat insufficient but design of refrigeration cycle possible provided that engine displacement is 2000 cc or greater. |

From the test results shown in Table 3 and taking into account also the margin for the difference due to selection of the automobile, it is understood that the invention is applied practically effectively when the factor $K_2$ is selected, i.e. the sucking condition I is determined, to meet the following condition.

$$0.025 < K_2 < 0.080$$

(II) In the case where an effective area of suction passage is changed during suction stroke:

The embodiment heretofore described applies to the case where the effective area of suction passage leading to the vane chamber can be regarded as being materially constant throughout the suction stroke. The explanation made hereinbefore using the factors $K_1$ and $K_2$ cannot apply, however, to the case where the change of effective area of suction passage opening according to the angular position of the vane is nonnegligible, as in the case where, for example, the opening of the suction passage to the vane chamber is formed to have a substantial length in the direction of running of the vane. This is because the value of $\eta$ is changeable within the region of $0<\phi<\pi$ depending on the function $K_1(\phi)$, since the factor $K_1$ is a function of $\phi$ in the formula (9) mentioned before.

For instance, in the case of the compressor having the suction port 6 in the side plate (rear panel) as shown in FIG. 1, the effective area of the suction passage opening leading to the vane chamber is gradually decreased in the final stage of the suction stroke in which the vane moves past the suction port 6. Also, the effective area of the suction passage is gradually restricted in the later half part of the suction stroke if the compressor, e.g. the compressor 50 shown in FIG. 13, has suction grooves 56 and the suction port 54 formed in the inner peripheral surface of the cylinder and the effective area $S_1$ determined by the groove width e and the number f of grooves is designed to be somewhat smaller than the suction port 54. As to the symbols e and f, reference shall be made to FIG. 6.

Figure 13:
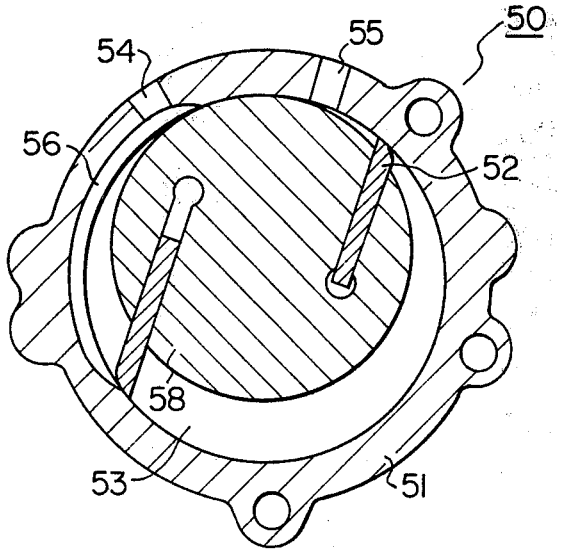
FIG. 13 is a front elevational sectional view of a rotary compressor in accordance with another embodiment of the invention.

In FIG. 13, reference numeral 58 denotes a rotor, 51 denotes a cyclinder, 52 denotes a vane, 53 denotes a vane chamber, 54 denotes a suction hole and 56 denotes a suction groove.

If the required characteristics of the compressor permit the shape of the suction groove as shown in FIG. 13, it is quite advantageous from the view point of mass production, because the keen portions of the cross-section can have roundness corresponding to the diameter of the machining tool.

Thus, in some cases, the compressors are designed to largely vary the effective area of the suction passage in the suction stroke, from the view point of production and general arrangement. A description will be made hereinunder as to the application of the invention to such cases.

Figure 14A:
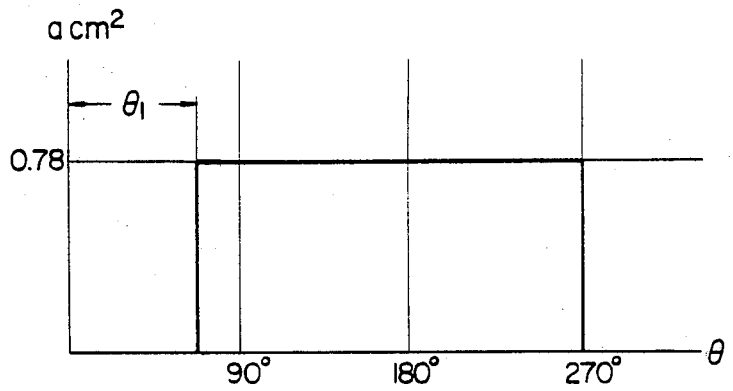
FIG. 14A is a graph showing the effective suction area in relation to the angular position $\theta$ of a vane in the case where the suction passage is closed in the earlier half part of the suction stroke.
Figure 14B:
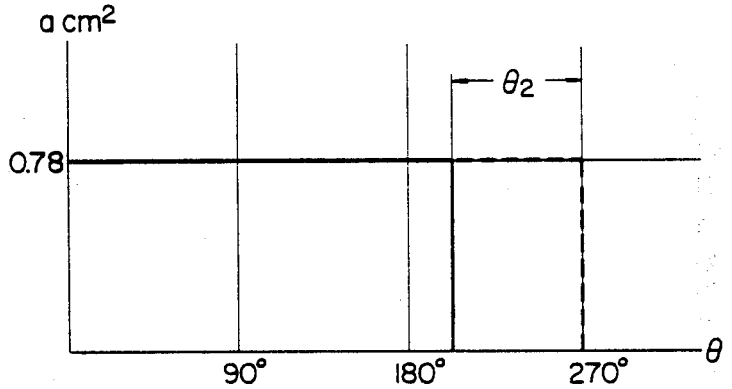

(i) In the case where the suction passage is closed in the earlier half part of the suction stroke:

A discussion will be made hereinunder as to how the pressure finally reached by the refrigerant is influenced when the suction passage is closed in a period in the earlier half part of the suction stroke as shown in FIG. 14, i.e. when the supply of the refrigerant to the vane chamber is stopped in the earlier half part of the suction stroke. To this end, an experiment was conducted numerically using the parameter values shown in Tables 1 and 2 except the effective area $a(\theta)$ and assuming the speed of revolution $\omega$ to be 3600 rpm.

Figure 15:
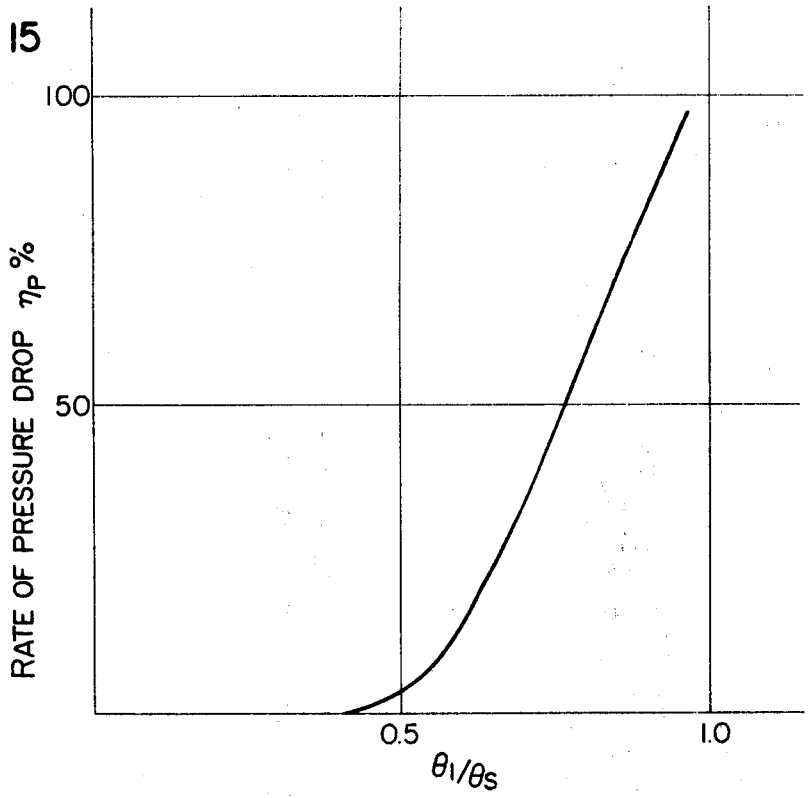
FIG. 15 is a graph showing the rate of pressure drop $\theta p$ in relation to a ratio $\theta_1/\theta_2$.

FIG. 15 shows the rate of pressure drop $\eta p$ in relation to a ratio $\theta_1/\theta_s$ where $\theta$ represents the region over which the suction passage in FIG. 14A is closed, i.e. the region of $a(\theta)=0$.

No substantial influence was caused on the final pressure of the refrigerant by the presence or absence of the suction passage when the ratio $\theta_1/\theta_s$ falls within the range represented by $0<\theta_1/\theta_s<0.5$. Namely, the rate $\eta p$ of pressure drop at the moment of completion of the suction stroke is determined solely by the suction port area $a(\theta)=0.78$ cm$^2$ in the later half part, regardless of the state or size of the opening of the suction passage in the earlier half part.

Figure 16:
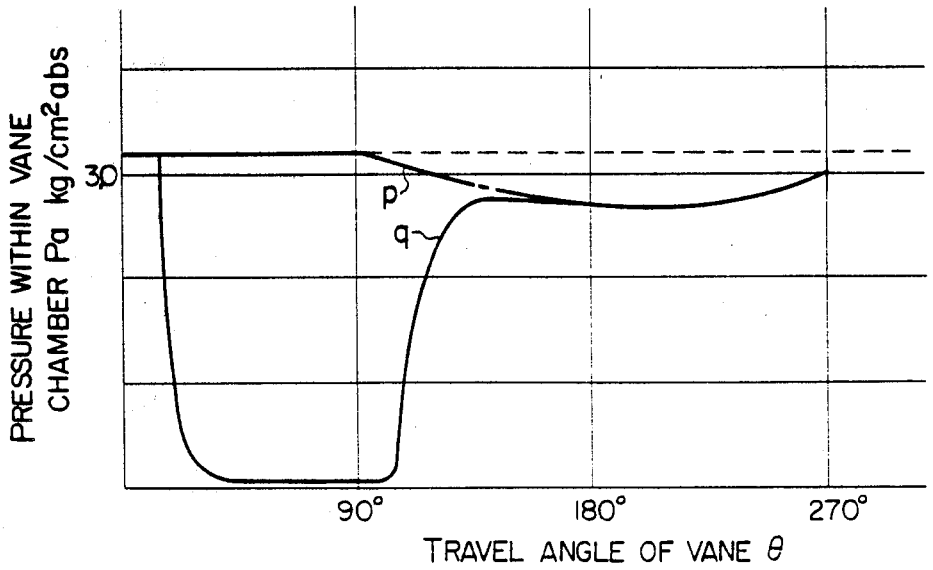
FIG. 16 is a graph showing the transient characteristics of the pressure Pa in the vane chamber.

FIG. 16 shows the transient characterisitics which are practical examples of the result of the above-mentioned experiment. More specifically, the curve p shows the characteristics as obtained when the area of the suction passage is maintained constant throughout the suction stroke, while the curve q shows the characteristics as obtained in the case where the suction passage is closed over the period represented by $0<\theta/\theta_s<0.37$. In the characteristic curve q, the pressure Pa is decreased largely in the region in which the fluid passage is kept closed, but the pressure is recovered rapidly as the fluid passage is opened. In fact, both characteristic curves p and q substantially overlap each other after the moment of completion of the suction stroke, i.e. after the position $\theta_s=225°$.

Figure 17:
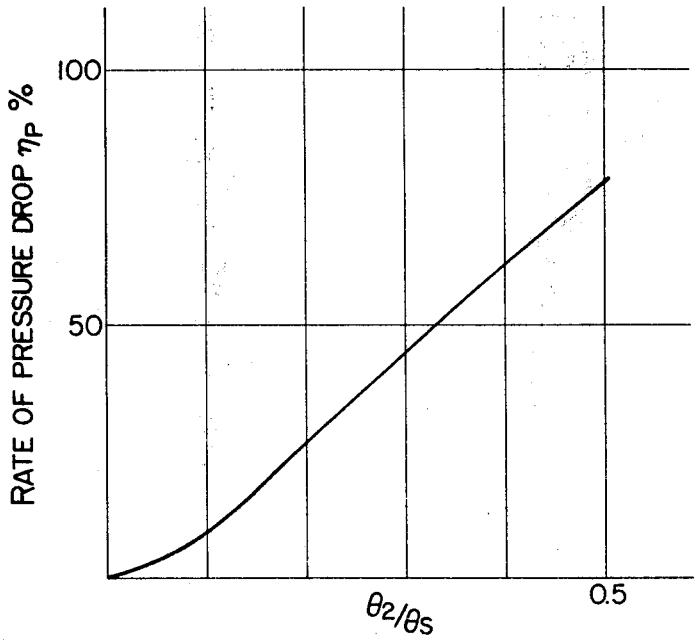
FIG. 17 is a graph showing the rate of pressure drop $\theta p$ in relation to a ratio $\theta_2/\theta_s$.

(ii) In the case where the suction passage is closed in the later half part:

FIG. 17 shows how the pressure finally reached by the refrigerant is influenced when the suction passage is closed over an angle $\theta_2$ in the later half part of the suction stroke.

The rate $\eta p$ of pressure drop is increased in proportion to the angle $\theta_1$, and takes a value of about 80% when the ratio $\theta_2/\theta_s$ amounts to 0.5.

The following fact is derived from the examination of the results (i) and (ii) mentioned above.

Namely, the influence on the final refrigerant pressure imposed by the state of the suction passage or the size of the opening area of the suction passage is largely changed depending on the angular position $\theta$ of the vane in the suction stroke. The influence is negligibly small in the earlier half part of the suction stroke, i.e. in the region of $0<\theta<\theta_s/2$, but the influence becomes greater as the angular position $\theta$ approaches the angle $\theta_s$.

This fact suggests that, by imparting a "weight" according to the position of the opening area $a(\theta)$, it is possible to obtain a suitable mean value $\bar{a}(\theta)$ of any desired function $a(\theta)$.

Figure 18:
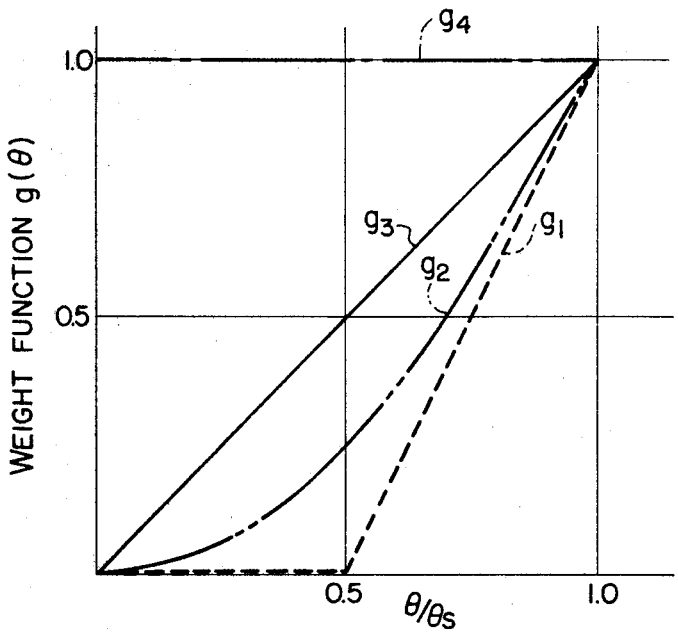
FIG. 18 is a graph showing various weight functions $g(\theta)$.

FIG. 18 shows various weight functions $g(\theta)$.

The function $g_1$ is a function represented by $g(\theta)=0$ in the region of $0<\theta/\theta_s<0$ and by $g(\theta)=2(\theta/\theta_s)-1$ in the region of $0.5<\theta/\theta_s<1$. The function $g_2$ is represented by $g(\theta)=(\theta/\theta_s)^2$. The function $g_3$ is represented by $g(\theta)=\theta/\theta_s$. The function $g_4$ is represented by $g(\theta)=1$.

The weight mean $\bar{a}$ is defined here as follows.

$$\bar{a} = \int_0^{\theta_s} g(\theta)\cdot a(\theta)d\theta \Big/ \int_0^{\theta_s} g(\theta)d\theta \qquad (17)$$

FIG. 18 shows the transient characteristics as obtained through formulae (3) and (4) using the data shown in Tables 1 and 2 except the area a, assuming the speed of revolution $\omega$ to be 3600 rpm, using the mean value $\bar{a}$ of the $a(\theta)$ obtained with the function $a(\theta)$ through each of the weight functions $g(\theta)$.

Figure 20:
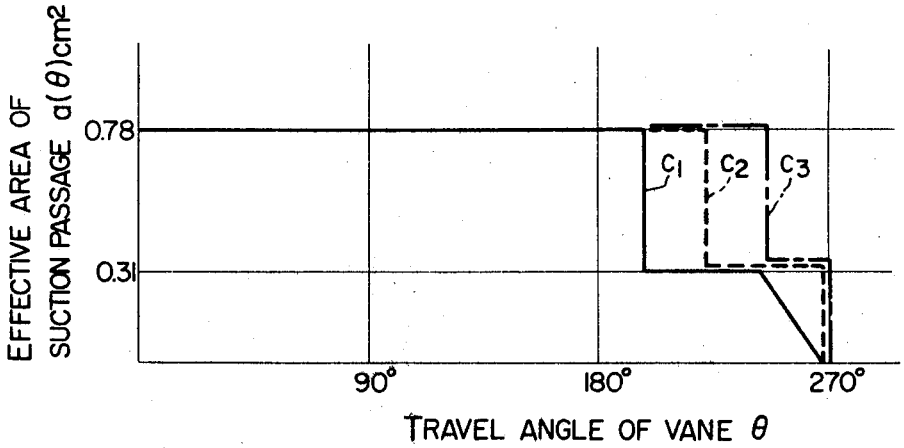
FIG. 20 is a graph showing the effective suction passage area $a(\theta)$ in relation to the angular position of the vane.

In this case, however, the value represented by $C_1$ in FIG. 20 is used as the area $a(\theta)$ of the suction passage. The pressure $Pa(\theta)$ in this Figure is a strict solution obtained without using any mean value. The "strict solution" is not a mere analytic solution but is a solution calculated exactly evaluating the area $a(\theta)$ of the suction passage.

TABLE 4

| Weight function | Weight mean $\bar{a}$ | Error from strict solution |
|---|---|---|
| $g_1$ | 0.365 cm$^2$ | −9.4% |
| $g_2$ | 0.450 | 0.3 |
| $g_3$ | 0.530 | 7.9 |
| $g_4$ | 0.630 | 17.3 |

Figure 19:
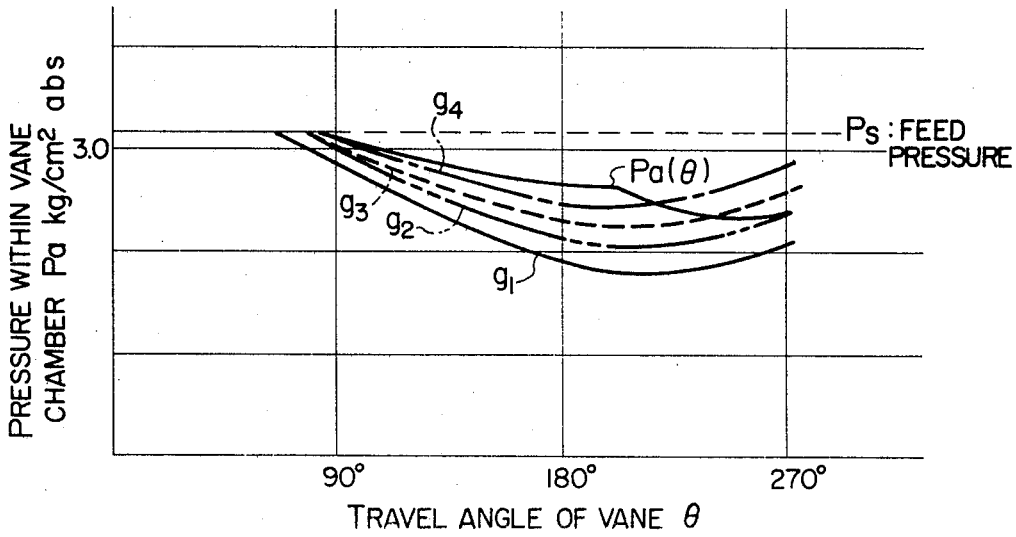
FIG. 19 is a graph showing examples of transient characteristics of the pressure Pa in the vane chamber.

In the test results shown in FIG. 19, the pressure drop $\Delta P$ from the supply pressure $Ps=3.18$ Kg/cm$^2$ abs at the position of completion of the suction stroke ($\theta=270°$) is calculated as $\Delta P=0.78$ Kg/cm$^2$ abs., according to the strict solution.

The pressure $Pa(\theta)$ according to the strict solution starts to drop largely again at the position of $\theta_{s1}=200°$. This is attributable to the reduction of the effective area $a(\theta)$ of the suction passage from 0.78 cm$^2$ down to 0.31 cm$^2$ at this position.

Table 4 shows the error of the value obtained through each weight function from the value obtained through the strict solution.

As will be seen from FIG. 19, a value somewhat smaller than that of the strict solution is obtained when the function $g_1$ is used as the weight function. To the contrary, the value obtained by the use of the weight function $g_2$ is somewhat greater than that obtained through the strict solution. Therefore, there is a relation represented by $g_1<g_2<g_3$, and, under this condition, the best approximation is obtained by the use of the function $g(\theta)=g_2=(\theta/\theta_s)^2$.

FIG. 20 shows the effective area $a(\theta)$ of suction passage in relation to the vane angular position $\theta$ as observed in the compressor having the suction groove shaped as shown in FIG. 13, for each of the three cases shown in Table 5 below.

TABLE 5

| | Angular position at which effective area changes | | Effective area $\bar{a}$ obtained by the use of weight function $g_2$ |
|---|---|---|---|
| | $\theta_{s1}$ | $\theta_{s2}$ | |
| $d_1$ | 200° | 250° | 0.450 cm$^2$ |
| $d_2$ | 220 | 270 | 0.551 |
| $d_3$ | 240 | 270 | 0.631 |

Figure 21:
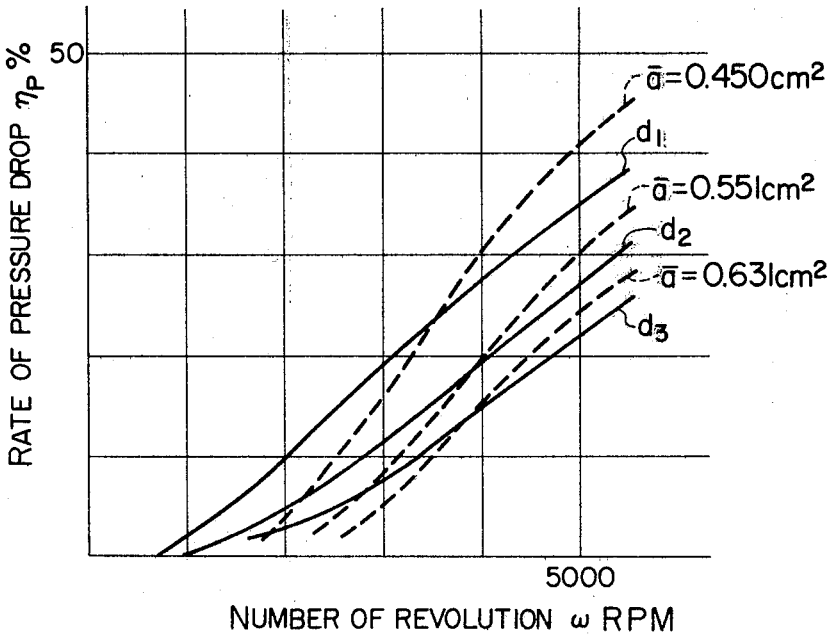
FIG. 21 is a graph showing the rate of pressure drop $\eta p$ in relation to the revolution $\omega$.

FIG. 21 shows the result of comparison between the rate of pressure drop in relation to speed of revolution as obtained through the strict solution and that obtained through the use of the weight mean $\bar{a}$, for each of the three cases $d_1$, $d_2$ and $d_3$.

In each case, a good approximation is obtained in the speed of revolution between 3000 rpm and 4000 rpm. Since the gradient of the curve of pressure drop rate is steeper in the case of the weight mean than in the case of strict solution, the pressure drop rate as obtained by the use of the weight mean $\bar{a}$ is somewhat greater than that obtained through the strict solution in the higher region of the speed of revolution, whereas, in the lower range of the speed of revolution, a somewhat greater value is obtained through the strict solution.

From this result, it is understood that in the case where the circumstance permits the selection of a suitable value of the factor $K_2$, it is more preferred to maintain a constant effective suction passage area than to gradually decrease the effective suction passage area in the suction stroke, for achieving ideal refrigerating capacity control characteristics.

The above-explained method provides an approximation of sufficiently high accuracy, so that it is possible to make the evaluation of the characteristics by means of the factor $K_2$ as in the case of the foregoing item (I).

To sum up, the present invention can be applied as follows to the ordinary compressors in which the effective area of suction passage is changed during the suction stroke:

(1) The effective area $a(\theta)$ in the passage between the evaporator and the vane chamber of the compressor is determined in the region of vane angular position $\theta$ of $0<\theta<\theta_s$;

(2) The weight mean $\bar{a}$ is determined using the effective area $a(\theta)$, in accordance with the following formula;

$$\bar{a} = \int_0^{\theta_s} \theta^2 a(\theta) d\theta / \int_0^{\theta_s} \theta^2 d\theta$$

(3) Subsequently, the value of the factor $K_2 = a\theta_s n/Vth$ is determined using the weight mean a;

(4) Finally, the evaluation of refrigerating capacity control is made from the value of the factor $K_2$, using data shown in Table 3.

Although the invention has been described with specific reference to a sliding vane type rotary compressor having two vanes, the invention can be applied to any type of compressor regardless of the discharge rate and the number of vanes of the compessor. The invention can be applied also to the case where the vane has no eccentricity from the center of the rotor, although the eccentric arrangement of the vane is preferred for obtaining a large discharge rate. It is also possible to apply the invention to the compressors in which the vanes are arranged at an irregular angular interval. In such an application, the refrigerating capacity control in accordance with the invention should be effected on the vane chamber having greater maximum sucking volume Vo.

Although the cylinder is illustrated to have a circular cross-section, this is not essential and the cylinder can have any other cross-section such as oval cross-section. The invention can be applied even to a single vane type compressor in which a single vane is slidably received by a slot formed diametrically in the rotor.

The use of the shape memorizing alloy as the temperature-sensitive material is not essential. Namely, it is possible to use other material such as a temperature-sensitive magnetic material, bimetal or the like as the temperature-sensitive material for constituting the valve.

In the embodiment described heretofore, the effective suction passage area is controlled upon detection of the temperature of refrigerant sucked into the compressor. This, however, is not exclusive. Namely, the change of the effective suction passage area can be achieved, for example, by means of a solenoid valve which operates in response to the temperature of the air in the passenger compartment of the automobile. Thus, the essential feature of the compressor of the invention resides in that the compressor can have both of the function to suppress the refrigerating capacity and the function for dismissing the suppressing function, by the suitable selection of the parameters of the compressor.

To sum up, the described embodiment applied to a sliding vane type rotary compressor offers the following advantages.

Namely, according to the described embodiment, the compressor is constructed to include a rotor carrying slidable vanes, a cylinder accommodating the rotor and vanes, side plates secured to both sides of the cylinder so as to close both open ends of the vane chambers defined by the vanes, rotor and cylinder, a suction port and a discharge port constituting passages communicating with the vane chambers, and a control valve disposed in the passage connected to the suction port and adapted to control the state of opening of the suction port in response to the refrigerant temperature, the cylinder having a top portion where the clearance between the rotor and the inner peripheral surface of the cylinder is smaller than at any other portion of the compressor, wherein the compressor is constructed to meet the requirement of:

$$0.025 < \theta_s \bar{a}_1 / Vo < 0.080$$

where, $\bar{a}_1$ is given by a formula of:

$$\bar{a}_1 = \int_0^{\theta_s} \theta^2 a_1(\theta) d\theta / \int_0^{\theta_s} \theta^2 d\theta$$

wherein, $a_1(\theta)$ represents the effective area ($cm^2$) of suction passage between the evaporator and the vane chamber in the state controlled in response to a low temperature of refrigerant sucked into compressor, $\theta$ represents the angle (rad) formed around the center of rotation of the rotor between the top portion of the cylinder and the instant position of the vane end adjacent to the cylinder and V represents the volume (cc) of the vane chamber at the position of completion of the suction stroke where the angle $\theta$ takes a value $\theta_s$, the compressor further satisfying the condition of:

$$\bar{a}_2 > \bar{a}_1$$

where, $\bar{a}_2$ is given by the following formula of:

$$\bar{a}_2 = \int_0^{\theta_s} \theta^2 a_2(\theta) d\theta / \int_0^{\theta_s} \theta^2 d\theta$$

wherein, $a_2(\theta)$ represents the effective area of suction passage when controlled in response to a high temperature of refrigerant sucked into the compressor.

According to the described construction of the compressor, it is possible to obtain a favourable refrigerating capacity control function in which, in the steady state of running of the automobile, the loss of the refrigerating capacity is minimized at the low speed, while the refrigerating capacity is effectively restrained at the high speed, whereas, in the transient state immediately after the start up of the automobile, the refrigerating capacity suppressing function is dismissed to provide good cooling down characteristics.

According to the invention, it is possible to obtain a refrigeration cycle in which the effective refrigerating capacity control and the rapid cooling down are selectively performed in accordance with demand.

What is claimed is:

1. A compressor having a rotor, a cylinder rotatably accommodating said rotor, vanes slidably carried by said rotor, side plates secured to both sides of said cylinder so as to close both open ends of cylinder chambers defined by said rotor, vanes and said cylinder, a suction port and a discharge port for a refrigerant, and a temperature-sensitive valve disposed in a passage leading to said suction port and adapted to control the state of opening of said suction port, characterized in that said compressor satisifies the following condition of:

$$0.025 < \theta_s \cdot a_1 / Vo < 0.080$$

where, $\bar{a}_1$ is given by the following formula of:

$$\bar{a}_1 = \int_0^{\theta_s} \theta^2 a_1(\theta) d\theta / \int_0^{\theta_s} \theta^2 d\theta$$

wherein, $a_1(\theta)$ represents the effective area ($cm^2$) of suction passage between an evaporator and said vane chamber in the state where said temperature-sensitive valve has been controlled, $\theta_s$ represents the angle (rad) of rotation of said rotor from the position at which the suction stroke is started and the position at which the suction stroke is completed, and Vo represents the volume of said vane chamber at said position at which the suction stroke is completed;

said compressor further satisfying the following relationship where, $\bar{a}_2$ is given by the following formula of:

$$\bar{a}_2 = \int_0^{\theta_s} \theta^2 a_2(\theta) d\theta / \int_0^{\theta_s} \theta^2 d\theta$$

where, $a_2(\theta)$ represents said effective area of suction passage in the state where said temperature-sensitive valve is in the opening position.

2. A compressor as claimed in claim 1, wherein said temperature-responsive valve is adapted to open and close in response to the temperature of said refrigerant sucked into said compressor, such that said suction passage is opened when said temperature is high and is restricted when said temperature is low.

3. A compressor as claimed in claim 1, wherein said angle $\theta_s$, volume Vo and said value $\bar{a}_1$ are selected to meet the condition of:

$$0.035 < \theta_s \bar{a}_1 / Vo < 0.070.$$

4. A compressor as claimed in claim 1, wherein said angle $\theta_s$, volume Vo and said valve $\bar{a}_1$ are selected to meet the condition of:

$$0.040 < \theta_s \bar{a}_1 / Vo < 0.065.$$

* * * * *